US005118016A

United States Patent [19]

Eisermann et al.

[11] Patent Number: 5,118,016

[45] Date of Patent: Jun. 2, 1992

[54] BOTTOM POUR TILES WITH SELF SEALING JOINT FOR POURING LIQUID STEEL

[75] Inventors: Eckehard Eisermann, Vermillion, Ohio; Eugen Hagen, Cologne, Fed. Rep. of Germany

[73] Assignee: Martin & Pagenstecher, Inc., North Olmsted, Ohio

[21] Appl. No.: 589,150

[22] Filed: Sep. 27, 1990

[51] Int. Cl.[5] ..... F16L 49/00

[52] U.S. Cl. ..... 222/597; 285/284; 285/332.1; 285/423; 285/917; 285/187; 266/236

[58] Field of Search ..... 285/284, 41, 10, 187, 285/423, 21, 22, 911, 917, 332.1; 277/26, 135; 222/597, 596, 598; 266/287, 283, 236

[56] References Cited

U.S. PATENT DOCUMENTS

| | | | |
|---|---|---|---|
| 3,168,766 | 2/1965 | Hornick | 222/597 |
| 3,280,911 | 12/1963 | Strange et al. | 285/332.1 |
| 3,341,092 | 9/1964 | Finn | 222/597 |
| 3,931,913 | 1/1976 | Meier | 266/236 |
| 4,171,832 | 10/1979 | Metcalfe | 285/187 |
| 4,363,504 | 12/1982 | DeFeo et al. | 285/187 |
| 4,373,705 | 2/1983 | Yamada | 266/236 |
| 4,538,834 | 9/1985 | Brady et al. | 285/10 |
| 4,603,842 | 8/1986 | King | 266/236 |
| 4,618,126 | 10/1986 | Tinnes et al. | 266/287 |
| 4,660,808 | 4/1987 | Duassan et al. | 266/287 |
| 4,747,580 | 5/1988 | Tinnes et al. | 222/598 |
| 4,984,769 | 1/1991 | Bruckner et al. | 266/236 |

*Primary Examiner*—Randolph A. Reese
*Assistant Examiner*—Tim Aberle
*Attorney, Agent, or Firm*—Caesar, Rivise, Bernstein, Cohen & Pokotilow, Ltd.

[57] ABSTRACT

A low tolerance joint connecting a pair of hollow refractory bricks, e.g., center riser bricks, runner bricks, etc., together for carrying molten metal, e.g., steel, therethrough. Each brick has a pair of ends with a central passageway extending therebetween. One end of one brick comprises a conical walled annular flange projecting therefrom and a shoulder extending about the annular flange. One end of the other brick comprises a matingly shaped circular recess and shoulder extending about the circular recess. The joint comprises the interface between the adjacent surfaces of the annular flange and recess when the flange is located therein. The interface thus formed is an elongated space, free of mortar or other sealing material, into which the molten metal flows to freeze therein and thereby form a seal precluding its egress from the passageway to the ambient surroundings.

12 Claims, 2 Drawing Sheets

BOTTOM POUR TILES WITH SELF SEALING JOINT FOR POURING LIQUID STEEL

BACKGROUND OF THE INVENTION

This invention relates generally to pouring of liquid steel, and more particularly to pour tiles for bottom pouring of liquid steel.

The technology of bottom pouring liquid steel was developed in Europe several decades ago. The technology is now employed all over the world at steel plants producing high quality steel grades, such as big forging ingots, bearing qualities, aircraft qualities, etc., to name a few. Prior to this development, liquid steel had been poured from the top into cast iron molds in which the steel solidified into ingots for further processing.

Such earlier techniques exhibited major disadvantages, such as gas pick-up during pour, poor ingot surface, poor internal cleanliness, segregation, reduced ingot yield, etc. Those drawbacks have effectively been eliminated by the use of bottom-pour technology.

As is known in bottom-pour technology, a series of refractory, hollow-wear shapes, such as trumpet bell bricks, center risers, spider bricks, runner bricks and gate bricks are set up. The refractory bricks are tightly gripped in cast iron sprue plates and cast iron flumes. Any space between the hardware and the refractory material is filled with sand, or another appropriate filler material. In fact, it has been a standard practice to mortar the joints between the different refractory bricks in order to form a sealed tubular system that allows the liquid steel to be poured therethrough without leakage.

After the bottom-pour system is set up, an activity undertaken with great care, liquid steel is poured from a steel ladle into the trumpet bell. The liquid steel flows through the refractory bottom-pour system and fills up the molds from the bottom to the top. Obviously, any leakage in the system has the potentially disastrous effect of the liquid steel breaking out. In such a case the whole heat may be lost if such an accident occurs. Moreover, persons in the area may become injured.

Currently, all bottom-pour refractory bricks have been supplied with cooperating male/female joint systems. The bricks each include a central passageway for the liquid steel to pass therethrough, with the central passageway having a longitudinally extending central axis. Each brick includes at least one male portion or "tongue" projecting outwardly from one end thereof and surrounding the central passageway, while the other end of the brick includes at least one correspondingly shaped "groove" surrounding the central passageway. In particular the tongue of any brick is in the form of an annular flange having an external face which extends at approximately 30° to the longitudinal central axis of the brick and at approximately 60° to the brick's end face ("shoulder"). The groove of any brick is a correspondingly shaped annular recess having a sidewall which extends at approximately 30° to the longitudinal central axis of the brick and at approximately 60° to the brick's end face. Typically the height of the tongue, i.e., the distance between the end face of the tongue and the shoulder from which the tongue projects, is approximately 10 mm, and the depth of the groove, i.e., the distance between the bottom of the groove and the shoulder into which it extends, is approximately 8 mm. Accordingly, when the tongue of one brick, e.g., a runner, is disposed within the groove of another brick, e.g., a sprue, so that the end face of the tongue abuts the bottom surface of the groove a gap of 2 mm thickness is created between the sidewall portions of the tongue of the runner and groove of the sprue and also between their adjacent shoulders. It is in this space or gap that mortar is applied to seal the joint.

In modern steel making practices, especially in North America, the bottom-pour refractory brick designs as described immediately above have been modified to effectuate faster bricking or assembly of the shapes by the elimination of the necessity for utilizing mortar at the joints. To achieve that end, the bottom-pour bricks or tiles were modified to reduce the joint tolerances as much as possible so that there would be a good sealed interface therebetween to prevent steel leakage at the interface even with no mortar between the joints. While such an approach has the advantage of eliminating the need for mortar it nevertheless suffers from various major disadvantages. In this regard, at present almost all bottom-pour tiles are manufactured by what is known as the "stiff-mud process". This process, by its nature, does not allow for the creation of tight tolerances in the manufacture of the bricks because the brick dimensions change from the initial green stage through the firing process of the bricks in the kiln. Accordingly, the bricks are approximately 4–6% smaller after the firing process, so that consistency of tight tolerances is impractical. Moreover, since bottom-pour refractory tiles are a consumable product, that is are used for only one application, the cost of manufacturing is a significant factor, thus the tiles must be inexpensive to manufacture in order to provide a product at a competitive price, notwithstanding the fact that the device may be cheaper to install. As an alternative to the "stiff-mud process" certain refractory suppliers, e.g., the Japanese, have begun developing a dry pressing process to manufacture bottom-pour bricks. Such a procedure allows for very narrow or tight refractory tolerances for the bricks to enable a tight fit between the male and female members, i.e., the tongue and the groove at the shoulders of the joint, so that an almost leak-proof joint is provided. However, bottom-pour tiles produced by the dry pressing process are significantly more expensive as compared to bricks or tiles made by the stiff-mud process. In fact the cost factor of two to three times the cost of bricks made by the stiff-mud process is not uncommon with the dry pressing process. Obviously such substantially higher manufacturing costs adversely affect the economics of bottom-pour technology.

OBJECT OF THE INVENTION

Accordingly, it is a general object of this invention to provide bottom-pour tiles which overcome the disadvantages of the prior art.

It is still a further object of this invention to provide bottom-pour tiles which allows the manufacture thereof by the stiff-mud process, at the same time providing resistance to steel leakage at the joints comparable to that of dry pressed bricks, yet at a significantly lower cost to manufacture than such dry pressed bricks.

SUMMARY OF THE INVENTION

These and other objects of the instant invention are achieved by providing a mortar-less, low tolerance, joint connecting a pair of first and second hollow refractory bricks, e.g., center riser bricks, spider bricks, runner bricks, gate bricks, etc., together for carrying molten metal, e.g., steel, therethrough. Each of the bricks has a first and a second end, and a central passageway extending therethrough. The first brick comprises an annular flange projecting from the first end and extending about the central axis and a shoulder extending about the annular flange. The annular flange has a top face and a side face, with the side face being generally conical. The second brick comprises a circular recess in the second end thereof extending about the central axis and a shoulder extending about the recess. The recess has a bottom face and a side face, with the side face being flared.

The joint connecting the two bricks comprises the interface between the flared surfaces of the annular flange and the recess when the annular flange is located within the recess, with the bottom face of the recess and the top face of the annular flange located immediately adjacent each other and the shoulders of the first and second bricks located immediately adjacent each other.

The interface is an elongated space into which the molten metal can flow to freeze therein and thereby form a seal precluding the egress of the molten metal from the passageway to the ambient surroundings.

DETAILED DESCRIPTION OF THE PREFERRED EMBODIMENT

Figure 1:
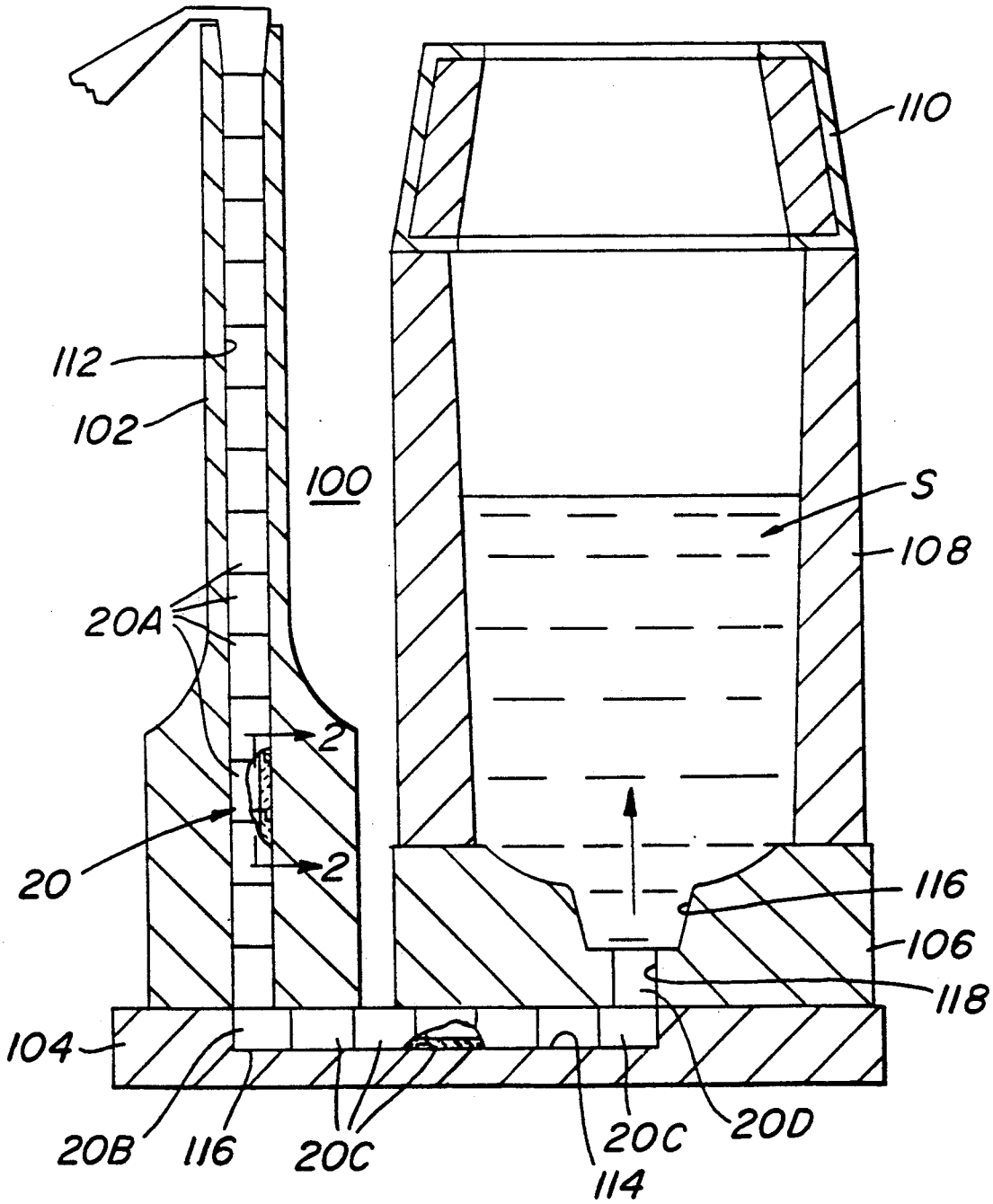
FIG. 1 is a side elevational view, partially broken away, of a portion of a molten steel bottom pour system utilizing the pour bricks of the subject invention.

Referring to FIG. 1, there is shown a portion of a typical molten steel, bottom pouring system 100 utilizing bricks 20 which are constructed in accordance with this invention. The bricks 20 are formed of any suitable, conventional, refractory material, by the conventional stiff mud fabrication process, without requiring high tolerance molding. To obviate the need for high tolerance joint components, e.g., tongues and grooves, the bricks 20 of this invention include means, to be described later, which forms a self-sealing joint when the bricks are exposed to the flow of molten metal therethrough.

Before describing the construction of the bricks 20 and their self sealing joints a brief description of the bottom pouring system 100 shown in FIG. 1 is in order. That system is conventional except for the bricks used therein. Thus, the pouring system 100 basically comprises a "trumpet" or flume 102, a sprue plate 104, at least one stool plate 106, vessel (commonly called a "mold") 108, and hot top 110. Depending upon the application the system 100 may include more than one mold to receive the molten metal S. In such applications there will be a respective stool plate 106 and hot top 110 for each mold 108 used. It should be pointed out that the use of stool plates and/or hot tops in system 100 is/are optional. Thus, for some applications such components may not be used.

The flume 102 is formed of cast iron or some other suitable material and includes a central, vertically oriented channel 112 which is lined with a plurality of center riser bricks 20A. Each of these bricks is constructed in accordance with this invention and each includes a central opening (to be described later) therein. The bricks 20A are connected to one another within the channel 112 so that their central openings conjoin to form a passageway for the molten metal S to flow therethrough to the sprue plate 104.

The sprue plate 104 is also formed of cast iron or some other suitable material and includes at least one horizontally disposed channel 114 therein. Thus, if the system 100 includes more than one mold the sprue plate 104 is configured to include a plurality of horizontally oriented channels 114 emanating from a central entrance-way or cavity 116 in which a spider brick 20B is located. If only one mold 108 is used the sprue plate is configured to have only a single channel 114.

Each of the channels 114 is lined with a plurality of runner bricks 20C. Each of the runner bricks is constructed in accordance with this invention and each also includes a central opening (to be described later) therein. The bricks 20C are connected to one another within the respective channels 114 so that their central openings conjoin to form respective passageway for the molten metal S to flow therethrough to a respective stool plate and associated mold.

The spider brick 20B is also constructed in accordance with this invention and includes an inlet which is connected to the lowermost of the center riser bricks 20A to receive the molten metal S therefrom. In the case where the system 100 includes plural molds 108, the spider 20B brick includes plural outlets (not shown), each in fluid communication with the inlet (not shown) via a central passageway (not shown). Each of the outlets is connected to the front-most runner brick 20C in each of the channels 114 so that the molten metal S entering the spider brick is distributed to the runner bricks 20C in the channels 114. The runner bricks 20C carry the molten metal to the stool plate 106 and its associated mold 108 In the case where the pouring system 100 includes only a single mold 108, and hence only a single channel 114 in the sprue plate, the spider brick 20B only includes a single outlet in fluid communication with the inlet to carry molten metal therefrom into the runner bricks in the channel 114, and from there to the stool plate and associated mold.

Each stool plate 106 is a horizontally disposed member formed of cast iron or some other suitable material and includes a bottom cavity 116 which forms the bottom of the associated mold 108. The mold itself comprises a hollow cylindrical member formed of cast iron or some other suitable material into which the molten metal S is directed. The hot top 108 comprises a lid for the mold 108 and is lined with an exothermic material to maintain the molten metal in its molten state in the mold. The use of a lid in the hot top of system 100 is optional. Thus, in some applications the hot top need not include a lid.

In order to effect the conveyance of the molten metal S from the runner bricks to the stool plate the rear-most runner brick 20C in each channel 114 is connected to a gate brick 20D which is also constructed in accordance with this invention. The gate brick 20D is located within a vertically oriented opening 118 in the stool plate 106 and serves to carry the molten metal from its associated runner brick channel 114 into the bottom of the stool plate, whereupon the vessel or mold fills from the bottom up.

Each of the bricks 20A-20D includes a portion which is shaped to mate with a correspondingly shaped portion of an immediately adjacent brick to form a mortarless joint therebetween. That joint is designated by the reference numeral 22 and need not be fabricated to a high tolerance to fit tightly together to prevent the egress of molten metal S therethrough. In fact, the joint 22 is arranged to enable some molten metal e.g., steel, to enter it. However, due to the nature of the joint the steel will freeze before exiting the joint at the joint's exterior surface. Thus, the bricks of this invention, when conjoined and subjected to the flow of molten metal therethrough form what can be regarded as a "self-sealing" joint. By so doing the bricks of the subject invention offer the economic advantages of low cost fabrication (via the stiff mud process), with the low construction costs inherent in the assembling a mortarless bottom pour tile system.

Figure 2:
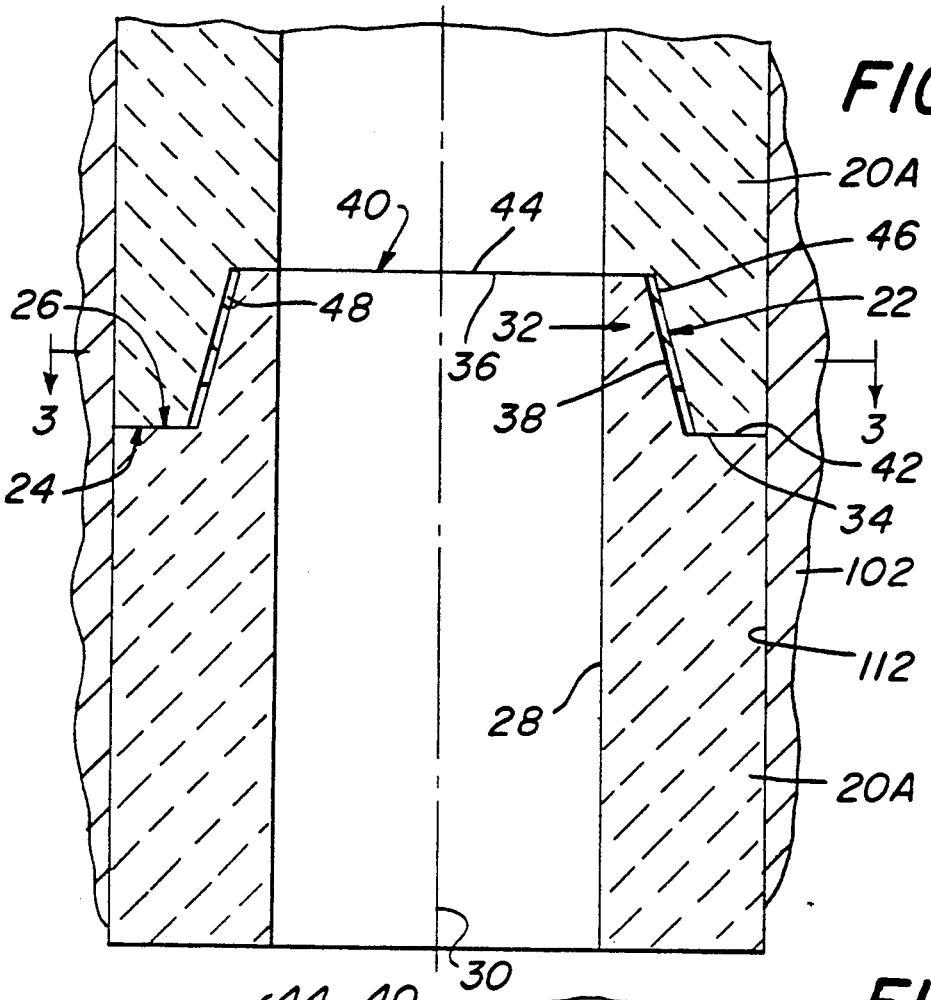
FIG. 2 is an enlarged sectional view taken along line 2—2 of FIG. 1 through the joint at the interface of two of the pour brick in the system.
Figure 2A:
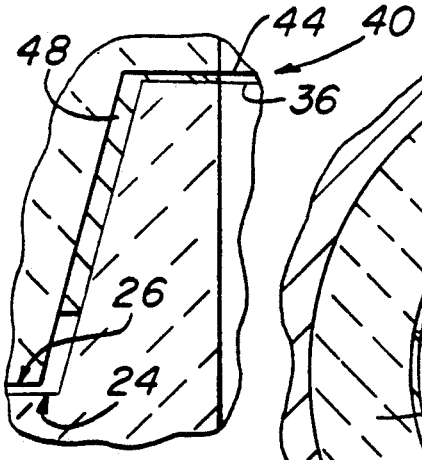
FIG. 2A is an enlarged view of the joint shown in FIG. 2, showing the presence of frozen metal therein.
Figure 3:
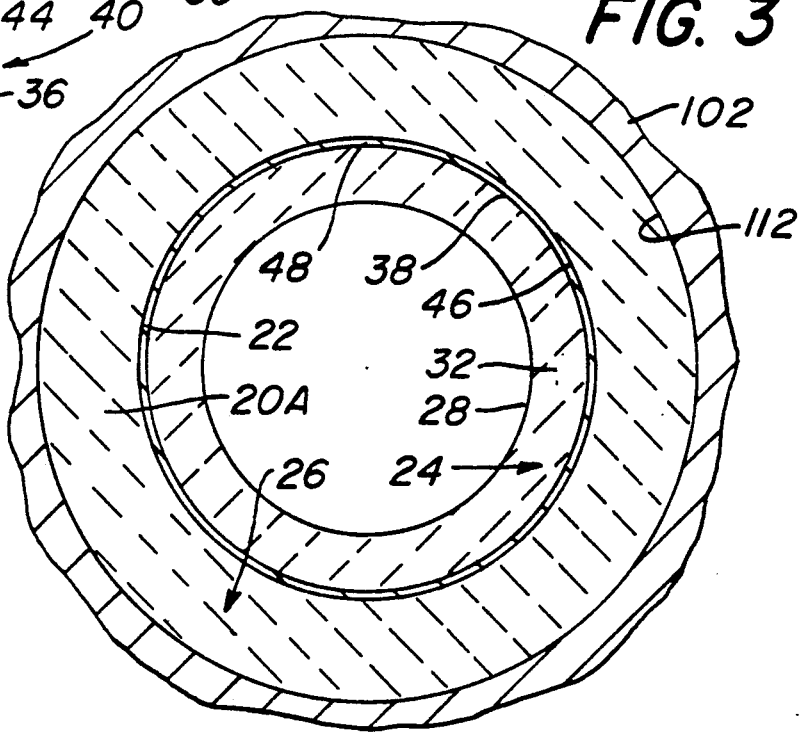
FIG. 3 is a sectional view taken along line 3—3 of FIG. 2.

In FIGS. 2 and 3 the details of a typical brick, e.g., a center riser brick 20A, constructed in accordance with this invention, is shown. It must be pointed out that the while the brick shown is a "center riser brick" 20B, that is merely exemplary, and may be any type of brick 20A-20D since each type includes the same type of means (to be described hereinafter) for forming a self sealing joint 22, with the only difference in the construction of the various types of bricks being the configuration of the brick itself, e.g., a round outer transverse profile for a center riser brick versus a square outer transverse profile for a runner brick, etc.

Thus, as can be seen in FIG. 3 the center riser brick 20A comprises an elongated member having a pair of ends 24 and 26 and a circular cross-sectional area passageway 28 extending down the length of the member between its ends 24 and 26. Being a center riser brick the outer transverse profile of the member is circular. The passageway 28 is centered around a longitudinally extending central axis 30 and serves as the conduit through which the molten metal S flows when the various bricks of the system 100 are connected together.

The end 24 of one brick is arranged to engage the end 26 of a preceding brick to form therebetween the self sealing joint 22. Thus as will be described now the ends 24 and 26 are of mating or cooperating shape to form the joint. In particular the end 24 of each brick 20A-20D basically comprises an annular flange 32 projecting from that end and extending about the central axis 30, and a contiguous shoulder 34 extending about the annular flange 32. The annular flange has a top face 36 and a side face 38, with side face being frusto-conical. The opposite end 26 of each brick 20A-20D basically comprises a circular recess 40 located therein extending about the central axis 30 and a contiguous shoulder 42 extending about the recess. The recess 40 has a bottom face 44 and a side face 46, with the side face being frusto-conical.

The annular flange 32 of one brick (called the "trailing brick" for convenience herein) is arranged to be disposed within the circular recess 40 of the immediately preceding brick (called the "leading brick") to form the joint 22. Thus, the joint is formed at the interface of the ends 24 and 26. In particular the annular flange 32 of the trailing brick is disposed within the circular recess 40 of the leading brick.

As mentioned earlier, there is no need for the ends 24 and 26 of the bricks to be precisely dimensioned with tight tolerances so that the surfaces 34, 38, and 36, of the end 24 of the trailing brick tightly abut the corresponding surfaces 42, 46, and 44, respectively, of the end 26 of the leading brick. Thus, there may be some space between those surfaces into which molten metal may flow from the passageway 28 for freezing in such space to thereby seal the joint 22.

In accordance with a preferred embodiment of this invention the outside diameter of the brick is 100 mm, the inside diameter of the passageway 28 is 50 mm. The maximum outside diameter of the frusto-conical side face of the flange 32, i.e., the portion at the interface with the shoulder 34, is approximately 74 mm, while the minimum outside diameter of the side face is approximately 65 mm. The height of the flange, i.e., the distance measured along axis 30 from the shoulder 34 to the top face 36, is 23 mm. Thus, the frusto-conical side face 38 extends at an angle of approximately 15° to the longitudinal central axis 30 of the brick. The maximum outside diameter of the frusto-conical side face of the circular recess 40, i.e., the portion at the interface with the shoulder 42, is approximately 76 mm, while the minimum outside diameter of the side face is approximately 67 mm. The height of the flange, i.e., the distance measured along axis 30 from the shoulder 34 to the top face 36, is approximately 23 mm. Thus, the frusto-conical side face 38 also extends at an angle of approximately 15° to the longitudinal central axis 30 of the brick.

With bricks constructed as just described and with the annular flange of one brick disposed within the circular recess of the immediately preceding brick the top face 36 of the flange 32 will be immediately adjacent or abutting the bottom surface 44 of the recess 40, with the two shoulders 32 and 42 also being immediately adjacent or abutting each other, and there will be an annular space 48 of approximately 2 mm wide measured radially between the surfaces 38 and 48. It is this space and the space, if any between the top face of the flange and the bottom face of the recess into which the molten metal may flow for freezing therein (see FIG. 2B).

It must be pointed out at this juncture that the above configuration and dimensions of the ends 24 and 26 are merely exemplary and any suitably shaped and/or sized ends may be used providing they cooperate to form a self-sealing, low tolerance joint.

Without further elaboration the foregoing will so fully illustrate our invention that others may, by applying current or future knowledge, adopt the same for use under various conditions of service.

We claim:

1. A bottom pour system for conveying molten metal, said system comprising a plurality of hollow, low tolerance, refractory bricks, each of said bricks having first and second ends and a central passage extending therethrough; the first end of each of said plurality of bricks being connected to the second end of an adjacent brick through a low tolerance, mortar-less joint, and with the central passages of said plurality of bricks being aligned along a central axis for receiving and directing molten metal therethrough, said first end of each of said plurality of bricks which is to be connected to a second end of an adjacent brick including an annular flange extending about said central axis and a shoulder extending about said annular flange, said annular flange having a top face spaced outwardly of said shoulder and a side face between said shoulder and top face, said side face being flared, said second end of an adjacent brick including a circular recess extending about said central axis and a shoulder extending about said recess, said recess having a bottom face, and a side face between said shoulder and bottom face, said side face being flared, said low tolerance joint comprising the interface between the flared side faces of said annular flange and said recess when said annular flange is located within said recess, whereupon said bottom face of said recess and said top face of said annular flange of adjacent. connected bricks are located immediately adjacent each other and said shoulders of said adjacent, connected bricks are located immediately adjacent each other, said interface being an elongated annular space into which said molten metal can flow, said elongated annular space being of a sufficient length for permitting said molten metal to freeze therein before passing completely through the connection between said adjacent bricks, to thereby form a self-sealing joint with the flared side faces of the flange and recess to preclude the egress of molten metal from said passageway to the ambient surroundings, said elongated annular space including frozen metal therein.

2. The bottom pour system of claim 1 wherein said refractory bricks are disposed within a vertically oriented channel of a metal housing.

3. The bottom pour system of claim 1 wherein each of said bricks has an outer periphery of regular geometric shape and wherein said passageway is circular.

4. The bottom point system of claim 1 wherein said second brick additionally comprises an annular flange projecting from said first end thereof and extending about said central axis and a shoulder extending about said annular flange, said annular flange having a top face and a side face, said side face being generally conical, and wherein said first brick comprises a circular recess in said second end thereof and extending about said central axis and a shoulder extending about said recess, said recess having a bottom face and a side face, said side face being flared, said first end of said second brick being arranged to form said joint with a third brick and said second end of said first brick being arranged to form said joint with a fourth brick.

5. The bottom pour system of claim 1 wherein said passageway in each of said bricks comprises a central longitudinal axis and wherein said flared surfaces are mating conical surfaces extending about said axes.

6. The bottom pour system of claim 1 wherein said elongated space comprises an annular space between the flared surfaces of said annular flange and said recess.

7. The bottom pour system of claim 1 wherein each of said bricks is approximately 100 mm wide, said passageway is approximately 50 mm in diameter, the distance from the top surface of said first brick to the shoulder of said first end is approximately 23 mm, and the distance from the bottom surface of said second brick to the shoulder of said second surface is approximately 23 mm.

8. The bottom pour system of claim 7 wherein said passageways include coincident central longitudinal axes, and said flared surfaces are mating conical surfaces extending about said axes at approximately 15 degrees thereto.

9. The bottom pour system of claim 4 wherein each of said bricks has outer periphery of regular geometric shape and wherein said passageway is circular.

10. The bottom pour system of claim 9 wherein each of said bricks is approximately 100 mm wide, said passageway is approximately 50 mm in diameter, the distance from the top surface of said first brick to the shoulder of said first end is approximately 23 mm, and the distance from the bottom surface of said second brick to the shoulder of said second surface is approximately 23 mm.

11. The bottom pour system of claim 5 wherein said conical surfaces extend at a small acute angle to said central longitudinal axis.

12. The bottom pour system of claim 11 wherein said small acute angle is approximately 15 degrees.

* * * * *